US005860534A

United States Patent [19]

Minneman et al.

[11] Patent Number: 5,860,534

[45] **Date of Patent: *Jan. 19, 1999**

[54] PORTABLE ORGANIZER

[75] Inventors: Allen J. Minneman, Union; Steven W. Minneman, Clayton, both of Ohio

[73] Assignee: MTM Molded Products Company, Dayton, Ohio

[ * ] Notice: The term of this patent shall not extend beyond the expiration date of Pat. No. 5,553,717.

[21] Appl. No.: 529,597

[22] Filed: Sep. 18, 1995

Related U.S. Application Data

[63] Continuation-in-part of Ser. No. 153,883, Nov. 17, 1993, Pat. No. 5,553,717, and a continuation of Ser. No. 30,890, Nov. 10, 1994, Pat. No. Des. 373,696.

[51] Int. Cl.[6] ..... A47F 5/00

[52] U.S. Cl. ..... 211/13.1; 211/133.6; 248/156; 108/25; 108/150

[58] Field of Search ..... 211/133, 126, 211/13; 206/562, 563, 564, 557; 108/25, 150; 248/156, 146

[56] References Cited

U.S. PATENT DOCUMENTS

| | | | |
|---|---|---|---|
| D. 162,207 | 2/1951 | Mettenleiter | 80/9 |
| D. 268,072 | 3/1983 | Boggs | 6/510 |
| 351,649 | 10/1886 | Newman | 108/150 X |
| 1,799,079 | 3/1931 | Bemis . | |
| 2,593,789 | 4/1952 | Pearson | 211/13 |
| 2,603,440 | 7/1952 | Vesconte et al. | 248/156 |
| 3,007,581 | 11/1961 | Moore | 211/64 |
| 3,022,898 | 2/1962 | Loeb | 211/64 |
| 3,156,062 | 11/1964 | Stevenson et al. | 42/94 |
| 3,391,960 | 7/1968 | Megargle et al. | 108/44 |
| 3,496,887 | 2/1970 | DuPont | 108/25 |
| 3,584,820 | 6/1971 | Butcher | 248/122 |
| 3,828,373 | 8/1974 | Fraley | 4/170 |
| 3,875,873 | 4/1975 | Howitt | 108/25 |
| 3,952,878 | 4/1976 | Gorham | 211/64 |
| 3,986,649 | 10/1976 | Heimstra | 224/42.46 B |
| 3,991,780 | 11/1976 | Maroski | 135/66 |
| 4,089,423 | 5/1978 | Gorham et al. | 211/64 |
| 4,144,971 | 3/1979 | Balibrea | 211/64 |
| 4,205,818 | 6/1980 | Lawler | 248/460 |
| 4,271,969 | 6/1981 | Gnesa | 211/64 |
| 4,524,701 | 6/1985 | Chappell | 108/44 |
| 4,531,643 | 7/1985 | Bradley | 211/64 |
| 4,545,144 | 10/1985 | Schuster | 42/94 |
| 4,896,854 | 1/1990 | St. Laurent | 248/156 |
| 4,913,389 | 4/1990 | McCracken | 248/156 |
| 4,940,003 | 7/1990 | Mayhew et al. | 108/44 |
| 5,039,052 | 8/1991 | Carafice | 248/309.1 |
| 5,058,302 | 10/1991 | Minneman | 42/94 |
| 5,069,375 | 12/1991 | Flick | 108/44 |
| 5,111,800 | 5/1992 | Reynolds | 124/88 |
| 5,333,745 | 8/1994 | Lehmann | 211/88 |
| 5,553,717 | 9/1996 | Minneman et al. | 211/13 |

*Primary Examiner*—Robert W. Gibson, Jr.
*Attorney, Agent, or Firm*—Jacox, Meckstroth & Jenkins

[57] ABSTRACT

This invention provides a method and apparatus for conveniently organizing weapon articles, such as rifles, shotguns, pistols, bows, arrows, ammunition, ammunition holders, eye and ear protection, muzzle loading equipment, tools and the like for use outdoors. The organizer comprises a tray member having a plurality of organizing areas for receiving one or more of the weapon articles. The tray member also comprises a plurality of notched areas and a slotted member having a slot for supporting, for example, rifles and a gun cleaner, respectively. The tray member is mounted on an I-shaped support which has a rung or engaging member towards a planting end thereof to facilitate forcing at least one spike located on the planting end into the ground. The organizer enables a shooter or archer to organize and support weapon articles at any desired location a predetermined distance above the ground to make it convenient and easy for them to shoot. Another embodiment is shown as providing a portable table having plurality of receiving areas which are configured to complement the articles which they are intended to receive, such as cups, glasses, plates and the like when the organizer is used as a table, for example, during camping.

28 Claims, 10 Drawing Sheets

10
12
12a
18
20
22
24a
24b
24c
24d
25
26a
26b
26c
27
28
29
30
30a
30b
30c
30d
30e
30f
30g
30h
31
32
33
34
35
36
38
40
41
42
43
14
14b
50
52
54
56
58
60
62
X
Y 34
20
18
30e
30f
42
32
24c
30g
24d
30h
31
33
43
22
38
30
27
29
34
36
16
41
38
35
14d
30d
30c
25
40
30a
30b
14a
14
50
60
D
58
52
14b
A
62
54
56

PORTABLE ORGANIZER

CROSS REFERENCE TO RELATED APPLICATIONS

This application is a continuation-in-part of U.S. patent application Ser. No. 08/153,883 filed Nov. 17, 1993 now U.S. Pat. No. 5,553,717 and a continuation of U.S. patent application Ser. No. 29/030,890 filed Nov. 10, 1994, now U.S. Pat. No. D373,696.

BACKGROUND OF THE INVENTION

1. Field of the Invention

This invention relates to a portable organizer, and more particularly, it relates to a multi-purpose portable organizer for organizing and supporting weapon articles.

2. Description of the Related Art

It is not uncommon for a shooter and archer during hunting or practice to place his weapon articles, such as weapons, ammo and accessories on the ground simply because he does not have a way to easily organize and support the weapon articles. Many times the archer or hunter has difficulty organizing his weapons and accessories for easy access use.

Some portable supports for bows and arrows are known in the art. For examples U.S. Pat. Nos. 3,007,581, 3,022,898, 3,156,062, 3,584,820, 4,089,423, 4,144,971, 3,952,875, 3,991,780, 4,271,969, 5,039,052, and Design U.S. Pat. No. 162,207, all disclose weapon supports. However, these devices do not provide a multi-purpose organizer for providing a stand which is capable of receiving a variety of weapon articles, including tools and accessories associated therewith, in a manner which will organize them into a predetermined or desired order.

Further, the weapon supports disclosed in these patents are typically designed for use with only one particular type of weapon and are thus of limited use. Yet another disadvantage associated with prior weapon supports relates to the height at which the weapon articles are supported wherein the weapon articles are typically positioned at a low, inconvenient height requiring a person to bend over to use the weapon support.

There is also a need to provide a portable organizer which may be used as a portable table, for example, and which facilitates organizing articles, such as dining articles, into a predetermined position.

SUMMARY OF THE INVENTION

An object of this invention is to provide a portable table which may be used as a portable table for supporting food items, for example, during camping.

Another object of this invention is to provide a tray member for organizing articles, such as weapon articles or camping articles, into a predetermined order.

In one aspect, this invention comprises an organizer for organizing weapon articles, the organizer comprising a tray member, an elongated support, and a connector for detachably connecting the tray member to the elongated support, the tray member comprising structure defining a plurality of organizing areas for receiving the weapon articles in order to organize them into a predetermined order.

In another aspect of the invention this invention comprises a weapon organizer comprising a planar tray member, at least one wing located on a side of the planar tray member, a support for supporting the planar tray member above the ground, and a connector for detachably connecting said planar tray member to the support, the planar tray member and at least one wing providing a first organizing area and a second organizing area, respectively.

In yet another aspect of the invention, this invention comprises a portable organizer for use with weapon articles, comprising a tray member, an elongated support member having tray mounting end and a planting end having at least one spike, an engaging member associated with the planting end for facilitating forcing the spike into the ground; and a connector coupled to an underside of the tray member to facilitate mounting the tray member on the mounting end of said elongated support member.

In still another aspect of the invention this invention comprises a method for organizing weapon articles, comprising the steps of detachably mounting a tray member on a mounting end of an elongated support, forcing a planting end of the elongated support into the ground, and placing the weapon articles into at least one of a plurality of organizing areas on the tray member.

It is an object of this invention to provide a very portable and durable organizer for organizing weapon articles.

It is still another object of this invention to provide an organizer which can be molded from plastic.

Another object of this invention is to provide an organizer which facilitates organizing weapon articles.

Another object of this invention is to provide an organizer which provides a generally planar platform at the desired operating distance from the ground.

Still another object of this invention is to provide a portable organizer which is capable of supporting a plurality of weapon articles, such as rifles, pistols, ammunition and accessories, like eye and ear protection.

Another object of this invention is to provide an organizer which will provide a platform to provide a place for a shooter or archer to put weapon articles at a predetermined height above the ground, thereby enabling the shooter or archer to avoid having to bend over.

Still another object of the invention is to provide a multipurpose portable organizer which conveniently organizes and supports a variety of weapon articles including accessories and tools.

Yet another object is to provide an organizer that facilitates the safe use of weapons.

These advantages, objects and others, may be more readily understood in connection with the following specification, claims and drawing.

DETAILED DESCRIPTION OF THE INVENTION

Figure 1:
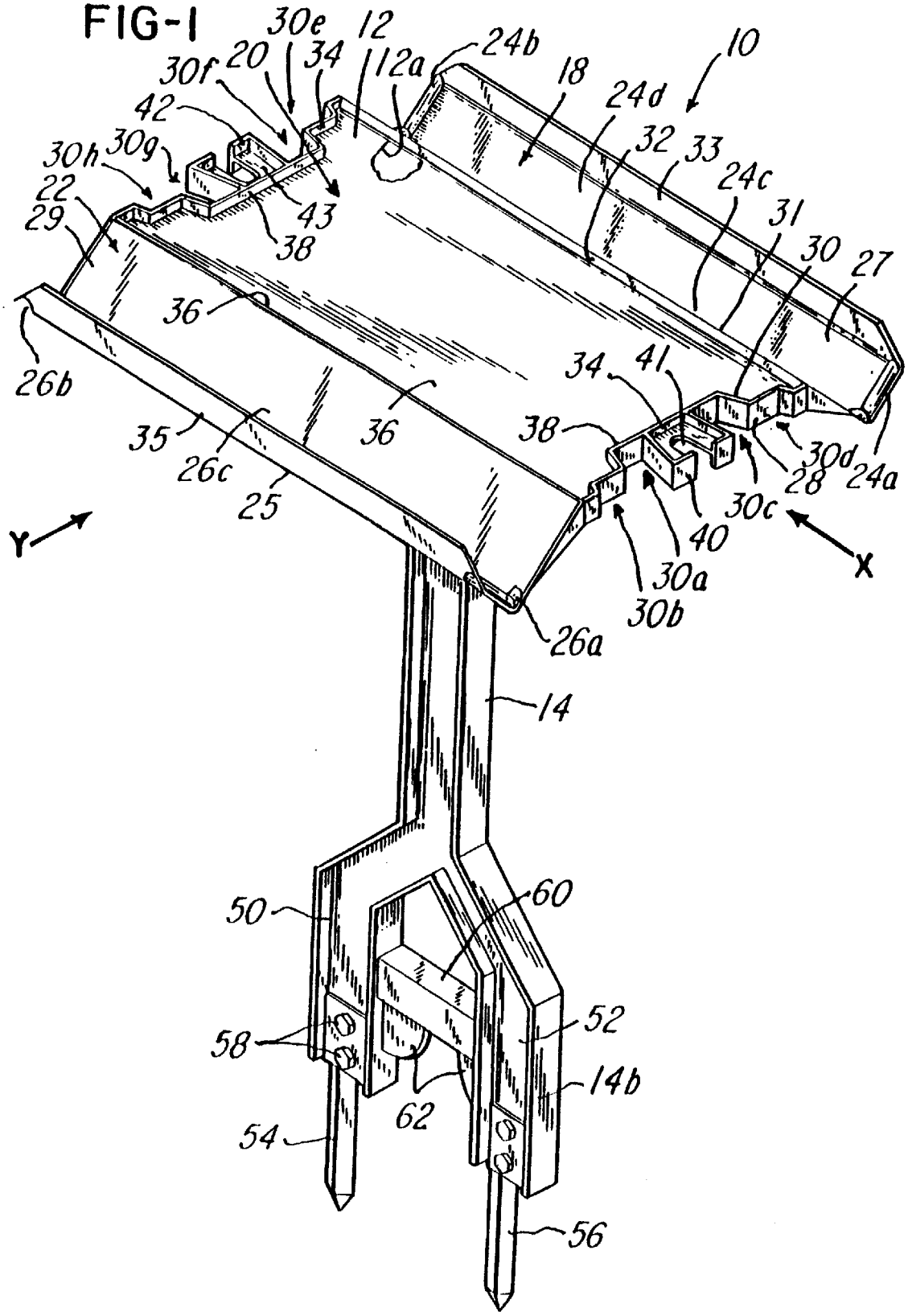
FIG. 1 is a perspective view of an organizer according to one embodiment of the invention.
Figure 7:
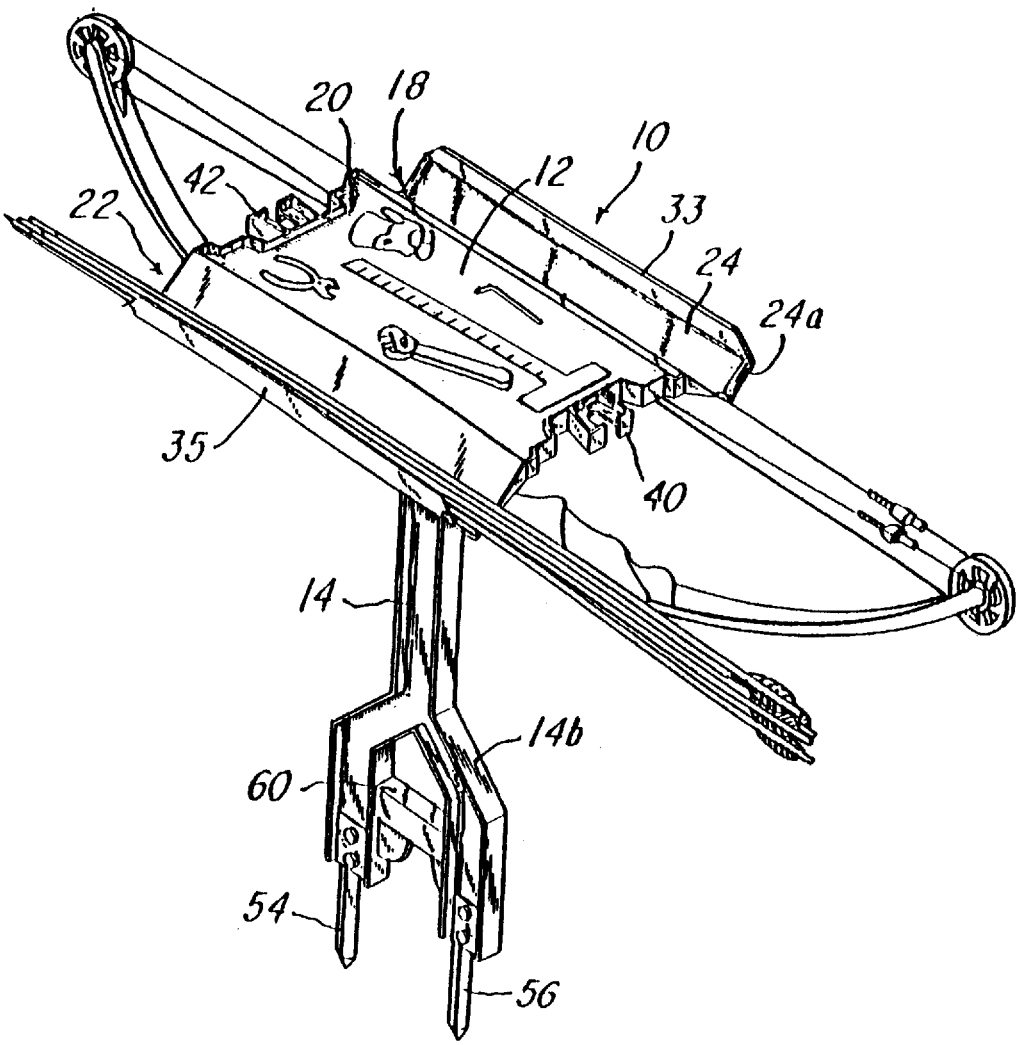
FIG. 7 is a view showing various weapon articles organized on the organizer.
Figure 8:
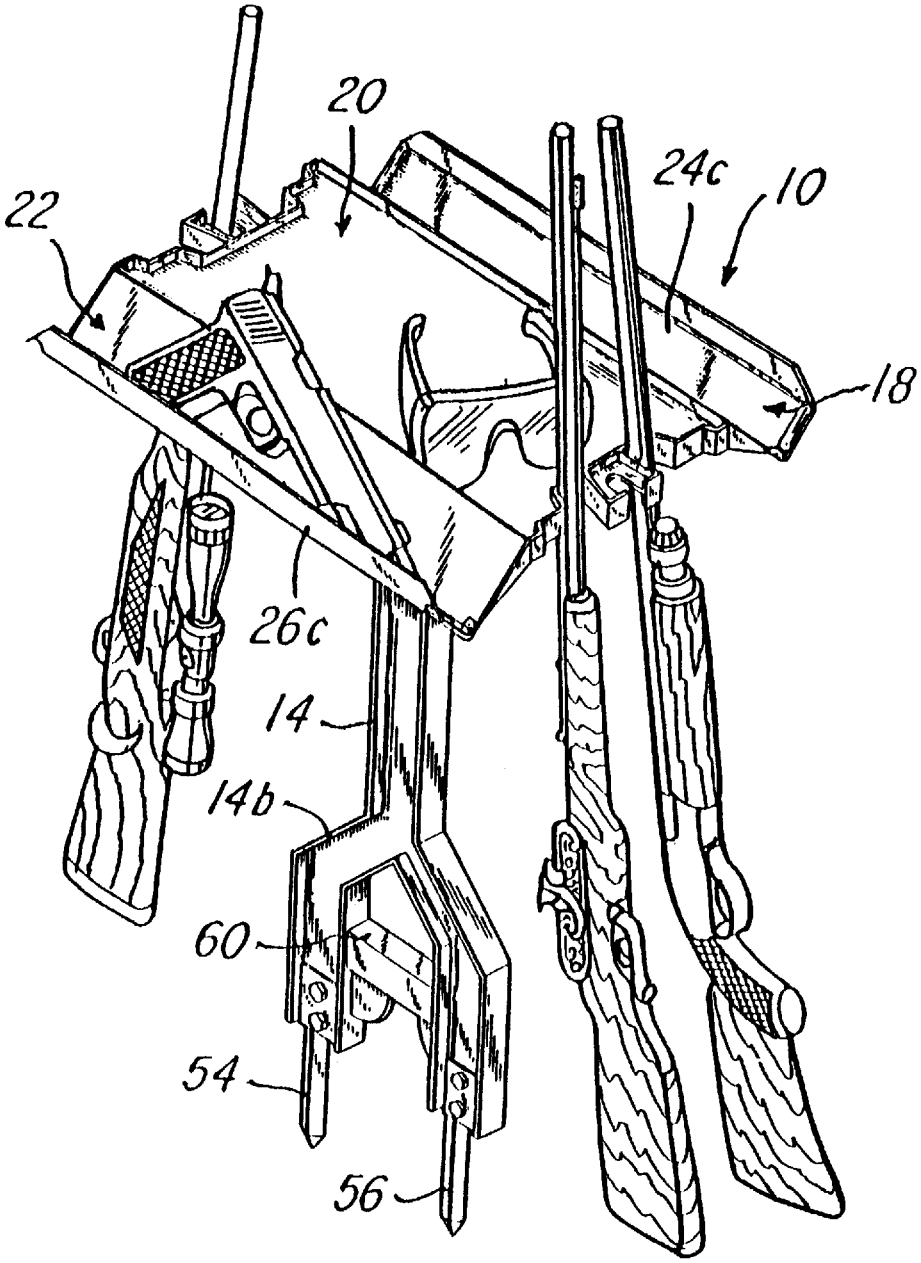
FIG. 8 is another view showing other weapon articles organized on the organizer.
Figure 9:
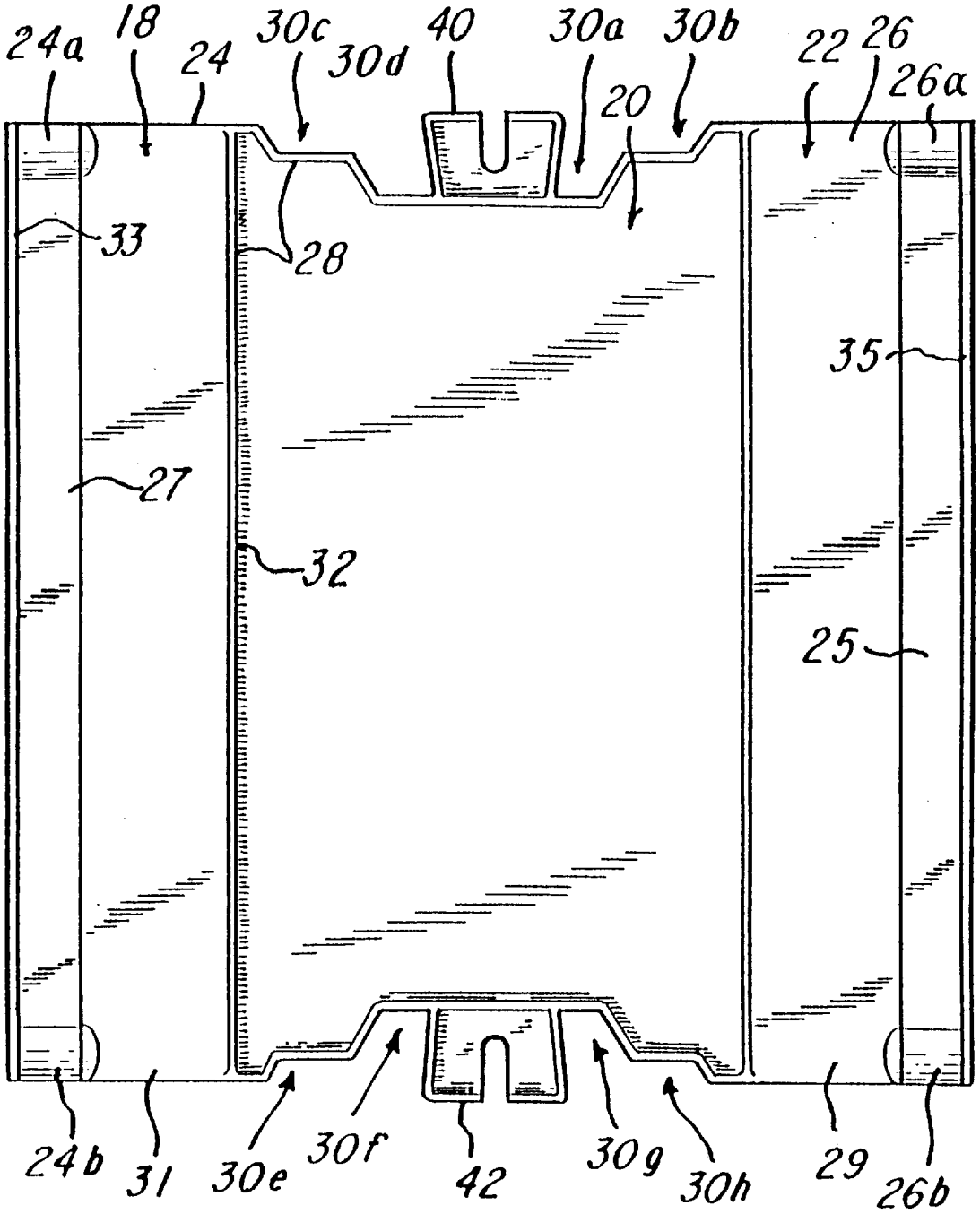
FIG. 9 is a top view of the tray member.

Referring now to FIG. 1, an organizer 10 for organizer weapon articles is shown. The organizer 10 comprises a tray member 12, an elongated support 14 and a connector 16 (FIG. 2) for detachably connecting tray 10 to elongated support 14. In the embodiment being described, the tray member 12 comprises structure defining a plurality of organizing areas, such as areas 18, 20 and 22. The organizing areas 18, 20 and 22 are capable of receiving weapon articles in order to organize them into a predetermined or desired order. As best illustrated in FIGS. 7 and 8, the weapon articles may comprise a variety of different weapons, armatures and tools associated therewith. For example, the weapon articles may include pliers, Alan wrenches, crescent wrenches and other tools for adjusting weapons and armatures as well as weapons such as bows, arrows, rifles, shotguns, pistols, rifle and pistol ammunition, and safety devices such as goggles, ear plugs, ear muffs, gloves and the like. The weapon articles may also comprise targets utilized during target practice, a scope for viewing downrange targets and a case for holding spent and unspent shells. In addition, the weapon articles may also comprise items utilized during skeet shooting such as clay pigeons and hand-held clay pigeon throwers.

Figure 2:
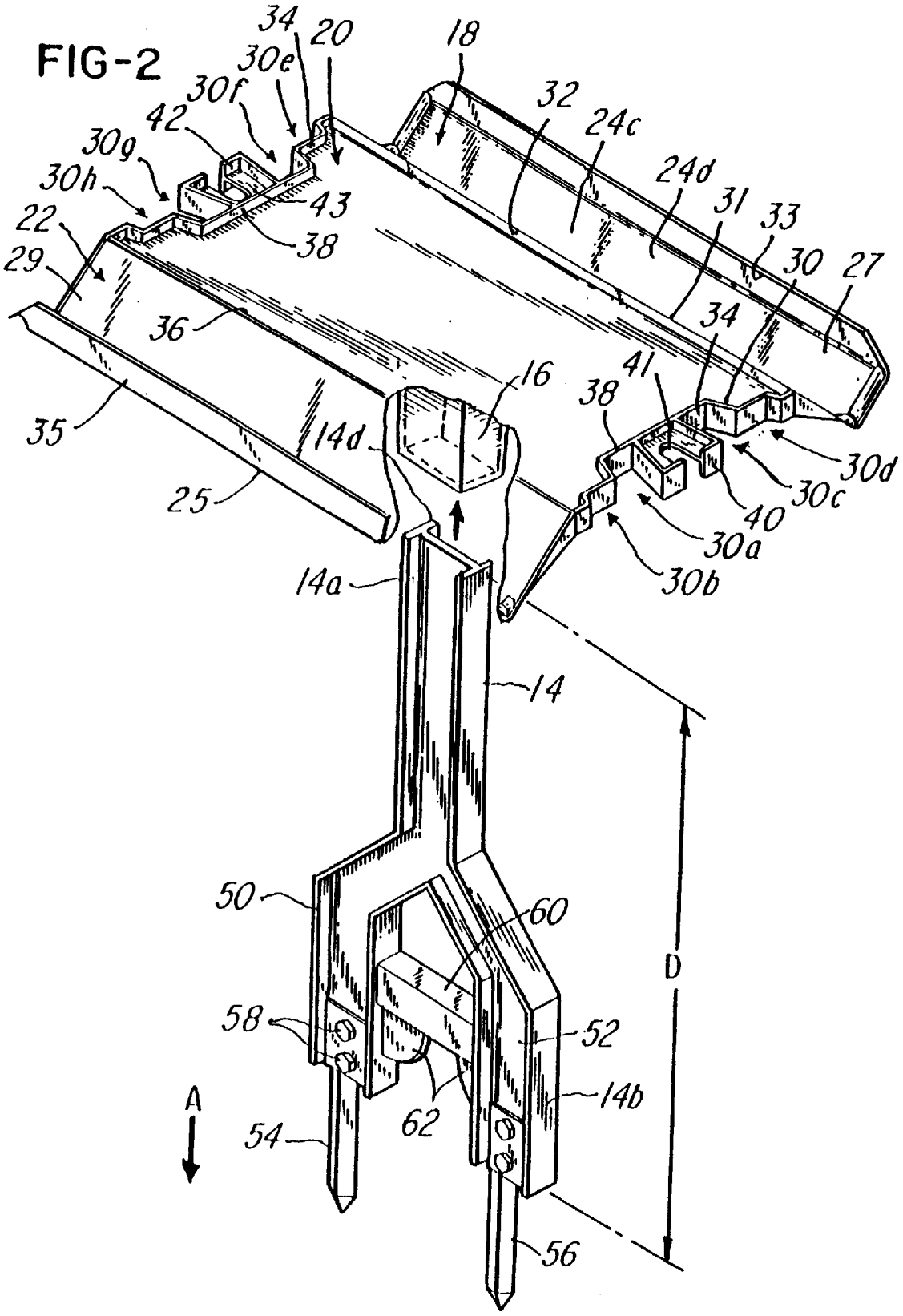
FIG. 2 is a fragmentary view of the organizer shown in FIG. 1.
Figure 3:
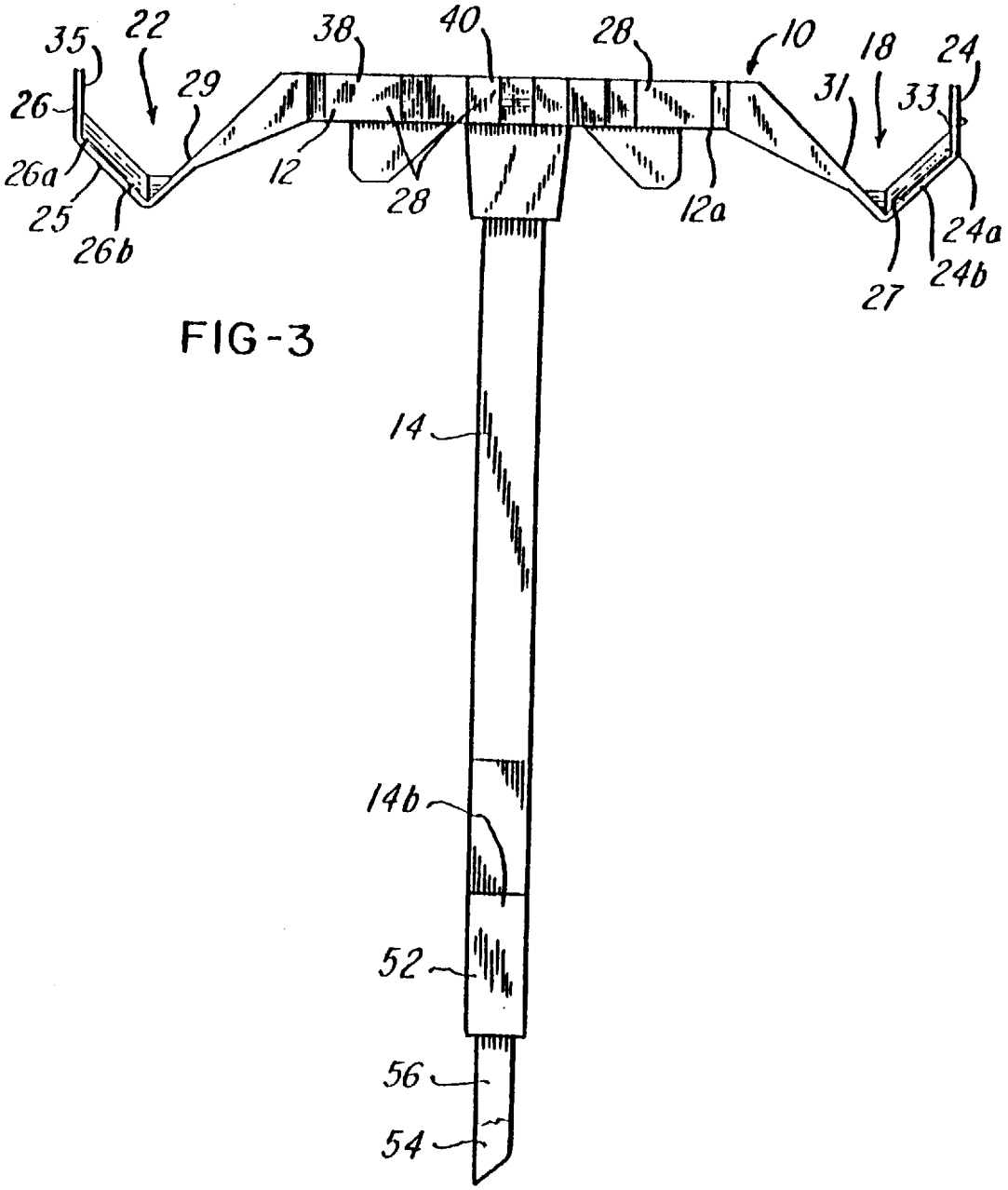
FIG. 3 is a side view taken in the direction of arrow X in FIG. 1.
Figure 4:
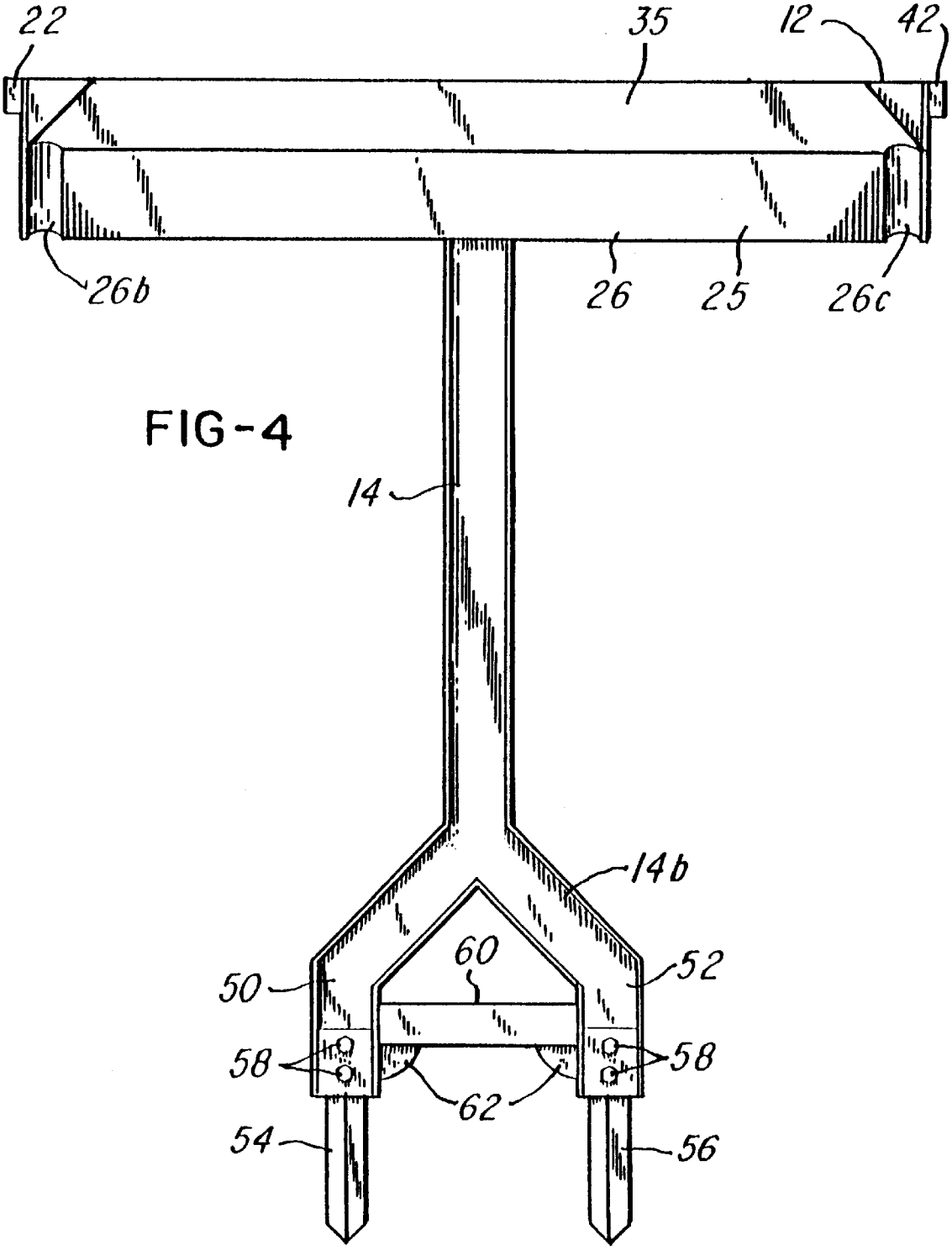
FIG. 4 is a front view of the organizer taken in the direction of arrow Y in FIG. 1.
Figure 5:
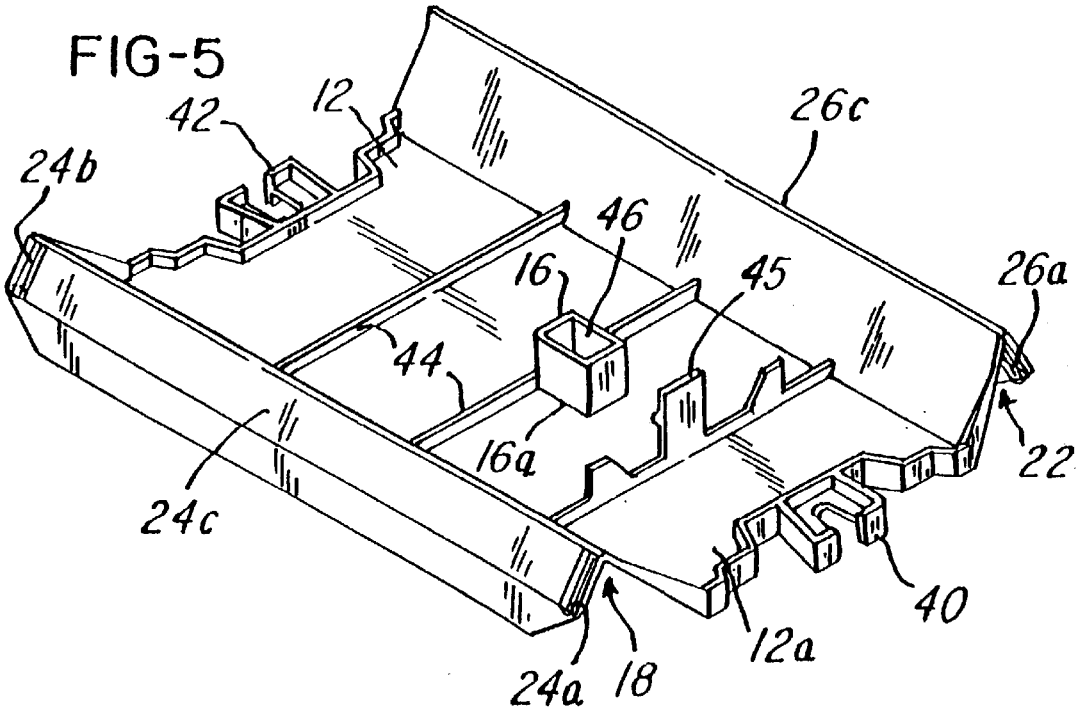
FIG. 5 is a bottom view of a tray member portion of the organizer shown in FIG. 1.

In the embodiment being described, organizing areas 18 and 22 each comprises at least one wing or trough 24 and 26 which may be utilized to organize or support one or more of the above-mentioned weapons articles illustrated in FIGS. 7 and 8. As best illustrated in FIGS. 3 and 5, the troughs 24 and 26 are generally U-shaped in cross-section. Troughs 24 and 26 each comprises bottoms 25, 27, walls 29 and 31 and flanges 33 and 35, as shown in FIGS. 1 and 2. It should be appreciated that the troughs 24 and 26 could be V-shaped or any other shape which is suitable for providing an organizing area 18 and 22. Also, the troughs 24 and 26 may include organizing compartments (not shown) or areas which divide these organizing areas 24 and 26 into smaller organizing areas. It is to be noted that each of the troughs 24 and 26 are generally elongated and comprise a pair of ridge portions 24*a* and 24*b*, 26*a* and 26*b*, respectively, which provide ends to the troughs 24 and 26 to define storage areas 24*c* and 26*c* within the troughs. The ridge portions 24*a*, 24*b*, 26*a* and 26*b* also facilitate keeping weapon articles within the trough. The ridge portions 24*a*, 24*b*, 26*a* and 26*b* also facilitate supporting weapon articles above the storage areas 24*c* and 26*c*. For example, as illustrated in FIG. 7, a bow may be supported by its bow strings on ridge portions 24*a* and 24*b* such that the entire bow string does not engage wall 24*d* of trough 24. As best illustrated in FIGS. 1–4 and 10, the ridge portions are generally U-shaped in cross-section, but they could be planar, V-shaped or any suitable shape for providing a wall or support member which provides the function of the ridge portion.

In the embodiment being described, the tray member 12 is generally planar and comprises an organizing area 20 which is generally rectangular and also comprises a generally rectangular receiving area for receiving one or more of the weapon articles. It is to be noted that the tray member 12 comprises a wall portion 28 which facilitates defining the receiving area 20. As best illustrated in FIGS. 1–6 and 9–10, the wall portion 28 comprises at least one notch, such as notched areas 30*a*, 30*b*, 30*c*, 30*d*, 30*e*, 30*f*, 30*g*, and 30*h*. As best illustrated in FIG. 8, the notched areas facilitate supporting at least one gun or rifle barrel in an upright manner.

Figure 6:
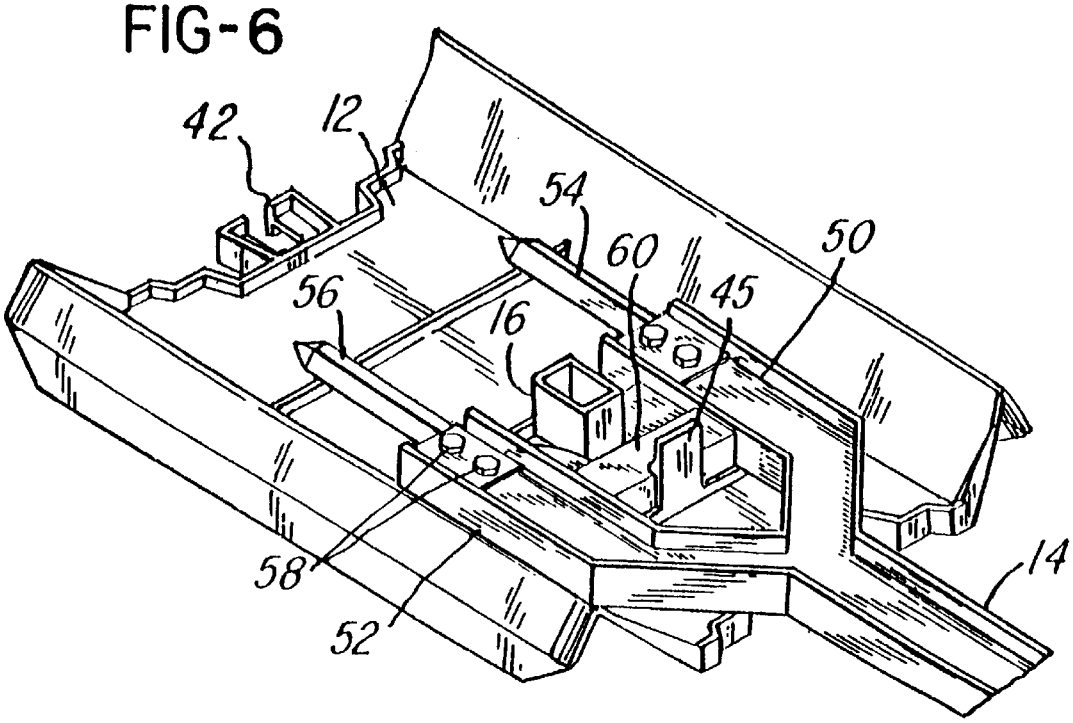
FIG. 6 is a fragmentary view showing how the underside of the tray member can be detachably mounted to a planting end of the support member for transporting the organizer.
Figure 10:
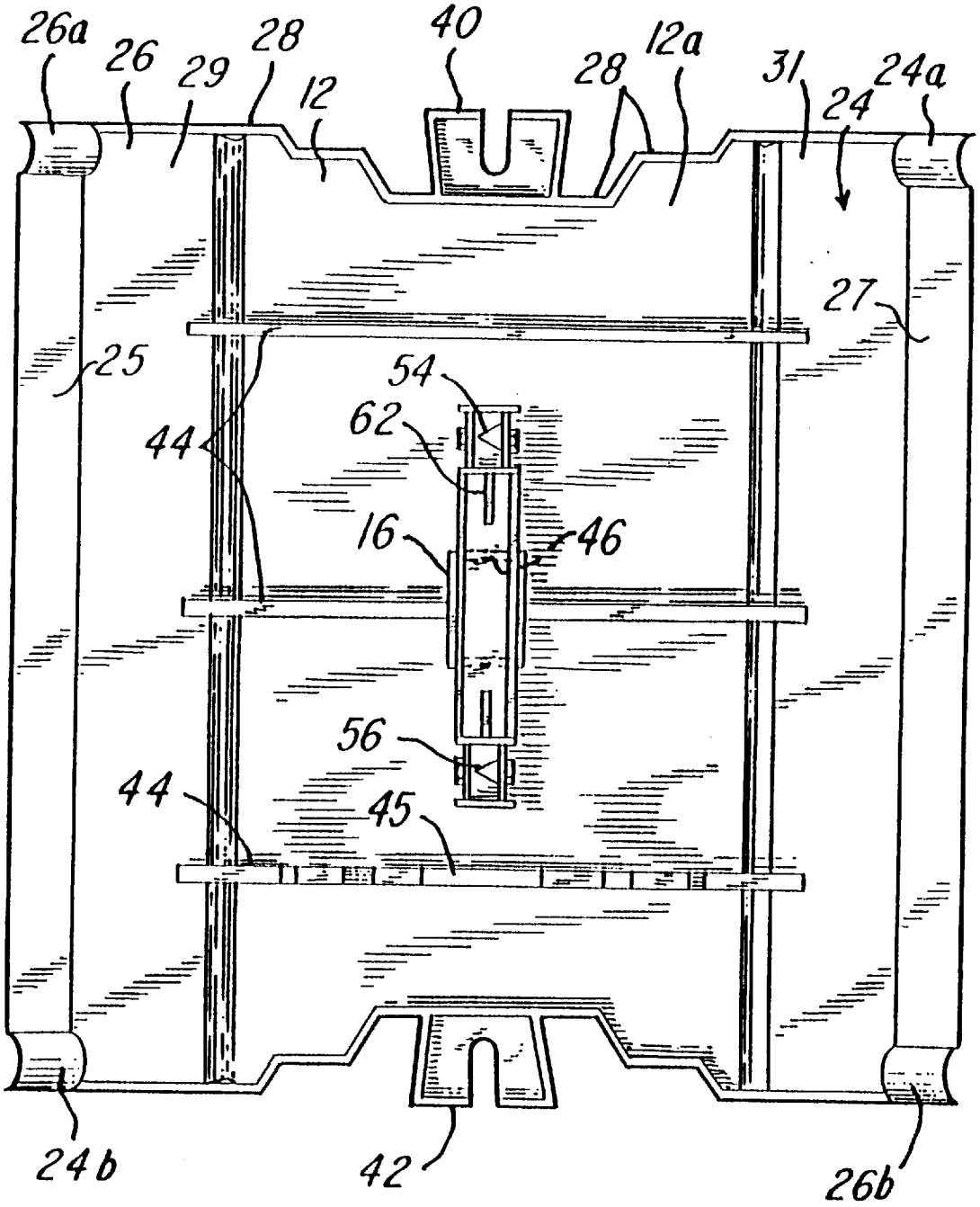
FIG. 10 is a bottom view of the organizer shown in FIG. 1.

In the embodiment being described, the wall portion 30 comprises walls 32 and 34 which are generally opposed to walls 36 and 38, respectively. As illustrated in FIGS. 1–6 and 9–10, walls 30 and 34 each comprise at least one slotted member 40 and 42, respectively, having a slot 41 and 43 therein which is capable of removably supporting a weapon article such as a rifle cleaning rod (not shown), or arrows (FIG. 7). As illustrated in FIGS. 4 and 10, an underside 12*a* of the tray member 12 comprises a plurality of strengthening ribs 44 which facilitate strengthening the tray member 12. As best illustrated in FIG. 4, the connector 16 has one end 16*a* integrally formed to the underside 12*a* of tray member 12. The connector 16 is generally rectangular and defines a receiving area 46 (FIGS. 4 and 10) for receiving elongated support 14. Notice also that underside 12*a* also comprises a retainer or detent 45 associated with connector 16 and which cooperates with connector 16 to secure the tray member 12 to planting end 14*b* of support member 14 when the organizer is being transported (FIG. 6). This feature facilitates making the organizer 10 very portable and easy to carry.

As shown in FIG. 2 support member 14 comprises a mounting end 14*a* and planting end 14*b*. The support member is generally I-shaped in cross section and, as mentioned above, is received in receiving opening 46 of connector 16 when tray member 12 is mounted on support member 14. The planting end 14*b* of support member 14 is generally Y-shaped and comprises a first leg 50 and second leg 52 each having at least one metal spike 54 and 56, respectively, secured thereto by any suitable fasteners such as screws 58 and bolts.

It should be appreciated, however, that spikes 54 and 56 could be plastic or they could be integrally molded or formed as part of legs 50 and 52, respectively.

The planting end 14*b* of support member 14 also comprises an engaging member 60 which connects the first and second legs 50 and 52 to provide a rung which facilitates forcing spikes 54 and 56 into the ground, for example, by foot pressure. In the embodiment being described, the engaging member 60 is integrally molded or formed between legs 50 and 52. Notice also that engaging member 60 comprises strengthening ribs 62 which facilitate strengthening planting end 14*b*. It should be appreciated that planting end 14*b* could be configured in other shapes and sizes and could be any suitable shape which is capable of securing the support member 14 generally vertical or perpendicular to the ground in which the organizer 10 is planted. It should also be appreciated that mounting end 14*a* generally complements the shape and configuration of receiving area 46 so that the tray member 12 can be mounted snugly thereto.

In the embodiment being described, the support member 14 has a suitable length D (FIG. 2) which enables the tray member 12 to be secured a predetermined or desired distance from the ground which is preferably not more than 36 inches.

The organizer 10 is generally 13 inches by 13 inches by 32 inches (after organizer 10 is planted in the ground). The tray member 12 and support member 14 are each a one-piece construction molded from plastic. In the embodiment being described, tray member 12 is molded from a high impact grade plastic so as to provide a durable construction which does not easily chip, break or crack. A method for organizing weapon articles using the organizer 10 will now be described.

The connector 16 on tray member 12 is generally aligned with mounting end 14*a* (FIG. 2) of support member 14 such that mounting end 14*a* can be slid into receiving opening 46 until an end 14*d* of mounting end 14*a* engages underside 12*a*. The planting end 14*b* is then forced downward in the direction of arrow A in FIG. 2 until spikes 54 and 56 are firmly planted in the ground. To facilitate forcing planting end 14*b* into the ground, it may be desired for a user to place his or her foot on engaging member 60 to force planting end 14*b* in the direction of arrow A. Once the organizer 10 is firmly planted in the ground, the weapon articles, such as those shown in FIGS. 7 and 8, may be placed in organizing areas 18, 20 and 22, thereby enabling a user to organize and support said weapon articles in a predetermined order. After the organizer 10 is used, tray 12 is dismounted from mounting end 14*a* and support member 14 is unplanted from the ground. As best shown in FIG. 6, the planting end 14*b* of support member 14 may then be positioned such that engaging member 60 is received between connector 16 and retainer 45, thereby making the organizer 10 portable and easy to transport.

Advantageously, the organizer 10 provides a multipurpose portable organizer for organizing weapon articles and for providing a useful platform that makes using the weapon articles more convenient and organized. The organizer 10 can be used by archers, shooters, black powder shooters and the like.

Figure 11:
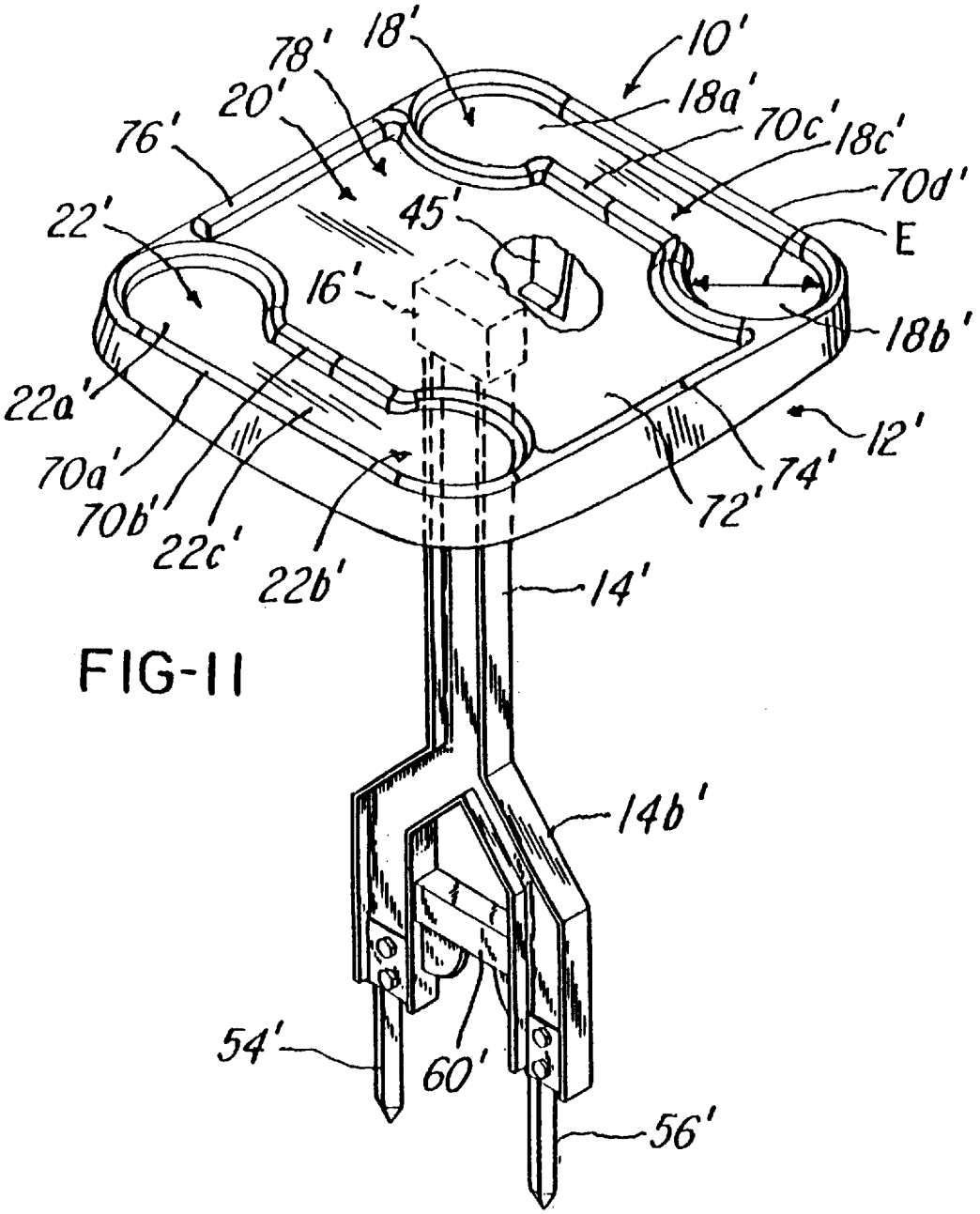
FIG. 11 is a perspective view of another organizer according to another embodiment of the invention.

FIG. 11 illustrates another embodiment of the invention that functions and operates similar to the embodiment shown and described with respect to FIGS. 1–10. The parts of the embodiment shown in FIG. 11 which are the same as the parts shown in the embodiment in FIGS. 1–10 have the same part number with a "'" added. In this embodiment, notice that tray member 12' also comprises structure defining a plurality of organizing areas, such as areas 18', 20' and 22'. The organizing areas 18', 20' and 22' are capable of receiving various types of articles in order to organize them into a predetermined or desired order. For instance, it has been found that the organizing areas 18', 20' and 22' are particularly suited for receiving various dining articles such as plates, cups or glasses, cutlery, food items and the like. The areas 18', 20' and 22' are defined by a plurality of walls 70*a*', 70*b*', 70*c*' and 70*d*'. The walls 70*a*', 70*b*', 70*c*' and 70*d*' are integrally molded as part of planar surface 72' and extend away therefrom on the order of ¼–½ inch in the embodiment being described. Although not shown, it should be appreciated that the walls 70*a*', 70*b*', 70*c*' and 70*d*' could be molded to comprise any desired shape in order to facilitate receiving articles to be organized and/or supported above the ground.

Notice that organizing area 18' comprises a generally cylindrical receiving areas 18*a*' and 18*b*', and organizing area 22' comprises a plurality of generally cylindrical receiving areas 22*a*' and 22*b*'. In the embodiment being described, the areas have a diameter E which is shown for ease of illustration relative to receiving area 18*b*'. The diameter E is 3–3½ inches in the embodiment being described, but could comprise any suitable diameter as desired. In this embodiment, the receiving areas 18*a*', 18*b*', 22*a*' and 22*b*' are suitable for receiving a can or bottle such as a beverage can or bottle, or any similarly shaped object.

The organizing areas 18' and 22' also comprise a generally elongated receiving area 18*c*' and 22*c*', respectively. These generally elongated receiving areas 18*c*' and 22*c*' are suitable for receiving various types of elongated articles, such as eating utensils, cutlery and the like. The tray member 12' further comprises walls 74' and 76' which cooperate with walls 70*b*' and 70*c*' to define a generally rectangular receiving area 70*a*' which is capable of receiving various articles, such as plates, drinking glasses, utensils, napkins and the like. This facilitates providing a full portable table for receiving, for example, a place setting which has been found to be convenient for use when outdoors, for example, while camping.

In the embodiment being described, the organizer 10 of the second embodiment is generally 13½ inches by 13½ inches by 23 inches (after organizer 10 is planted in the ground) by 1½ inches width.

The tray member 12' and support member 14' are each a one-piece construction molded from plastic. The tray member 12' is molded from a high-impact grade plastic so as to provide a durable construction which does not easily chip, break or crack. A method for organizing articles using the organizer 10' will now be described.

The connector 16' on tray member 12' is generally aligned with mounting ends 14*a*' of support member 14' such that mounting in 14*a*' can be slid into connector 16' in the same manner as described above relative to FIGS. 1–10 in the first embodiment. The planting end 14*b*' is then forced downward in the direction of arrow F until spikes 54' and 56' are firmly planted in the ground. To facilitate forcing planting end 14*b*' into the ground, it may be desired for a user to place his or her foot on engaging member 60' to force planting end 14*b*' in the direction of arrow F. Once the organizer 10' is firmly planted in the ground, the articles, such as the dining articles, food, beverages and the like, may be placed in organizing areas 18', 20' and 22', thereby enabling a user to organize and support such articles in a predetermined order above the ground.

After the organizer 10' is used, tray 12' is dismounted from support member 14' as described earlier herein and the support member 14' is unplanted from the ground.

As with the embodiment described earlier herein, the planting end 14*b*' of support member 14' may then be positioned such that engaging member 60' is received between connector 16' and retainer 45', thereby making the organizer 10' portable and easy to transport.

Advantageously, this organizer provides portable means for supporting articles, such as camping articles, above the ground. Although the camping articles have been described as primarily dining articles, this embodiment is especially convenient for use in providing support for other camping items, such as radios, lanterns, lamps, candles, cards, games, food, clothing and the like.

Notice also that the organizer 10 is versatile and can be used for other purposes, such as supporting a telescope for viewing targets downrange, providing arm support during rifle shooting.

Similar advantages are achieved with the embodiment disclosed and described relative to FIG. 11. It should also be appreciated that the tray member 12' could be configured to provide receiving areas having any desired shape. Also, although not shown, support member 14' may be provided in a first section (not shown) and a second section (not shown) which are adjustably coupled together, for example, using a screw and wing nut so that the length B (FIG. 2) can be adjusted. This would facilitate adjusting the height of, for example, the portable organizer table shown in FIG. 11. Also, although not shown, a handle may be integrally molded or fastened to one of the walls 70*a*', 70*d*', 74' and/or 76' in order to facilitate providing a handle for carrying or transporting the organizer 12'.

Various changes or modifications in the invention described may occur to those skilled in the art without departing from the true spirit or scope of the invention. The above description of the invention is intended to be illustrative and not limiting, and it is not intended that the invention be restricted thereto but that it be limited only by the true spirit and scope of the appended claims.

What is claimed is:

1. An organizer for organizing articles, said organizer comprising:

a tray member;

an elongated support having a planting end which can be forced into the ground;

a connector for detachably connecting said tray member to said elongated support; and said tray member comprising structure defining a plurality of organizing areas for receiving said articles in order to organize them into a predetermined order.

2. The organizer as recited in claim 1 wherein said plurality of organizing areas comprises at least one trough.

3. The organizer as recited in claim 2 wherein said trough is generally U-shaped in cross section.

4. The organizer as recited in claim 1 wherein a portion of said tray member is generally planar.

5. The organizer as recited in claim 3 wherein a portion of said tray member is generally planar and said trough is located on a side thereof.

6. The organizer as recited in claim 1 wherein said tray member comprises a first organizing area, a second organizing area and a third organizing area.

7. The organizer as recited in claim 6 wherein at least one of said first, second, or third organizing areas provides a generally rectangular receiving area for receiving said articles.

8. The organizer as recited in claim 1 wherein said tray member comprises at least one receiving area which is generally cylindrical.

9. The organizer as recited in claim 1 wherein said tray member comprises a plurality of walls which define at least two receiving areas which are generally cylindrical.

10. The organizer as recited in claim 1 wherein said articles comprise a beverage container, at least one of said plurality of organizing areas comprises a shape which generally complements the shape of said beverage container.

11. The organizer as recited in claim 1 wherein said elongated support member comprises a planting end and a mounting end; said planting end comprising at least one stake member for securing the organizer into the ground such that said tray member is positioned a predetermined distance above the ground.

12. The organizer as recited in claim 11 wherein said predetermined distance is not more than 36 inches.

13. The organizer as recited in claim 11 wherein said planting end is generally Y-shaped.

14. The organizer as recited in claim 11 wherein said planting end comprises an engaging member for facilitating forcing said stake into the ground.

15. The organizer as recited in claim 14 wherein said planting end comprises a first leg member and a second leg member, said engaging member being located between said first and second leg members.

16. The organizer as recited in claim 1 wherein said connector is generally tubular and has an end coupled to said tray member so as to define a receiving area for detachably receiving a mounting end of said elongated support.

17. The organizer as recited in claim 16 wherein said connector is generally rectangular in cross section.

18. The organizer as recited in claim 1 wherein said tray member defines a camper table having a length of not more than 34 inches and a width of not more than 34 inches.

19. A method for organizing articles, said method comprising the steps of:

situating a tray member, detachably connected to an elongated support having a planting end which can be forced into the ground, at a predetermined distance above the ground, said tray member comprising a plurality of organizing areas; and placing at least one of said articles on said tray member such that at least one of said articles becomes organized thereon.

20. The method as recited in claim 19 wherein said method further comprises the step of:

placing a plurality of said articles on said tray member so that they become organized.

21. The method as recited in claim 20 wherein said method further comprises the step of:

placing a weapon article in at least one of said plurality of organizing areas.

22. The method as recited in claim 19 wherein said articles comprise a dining article, said method further comprising the step of:

placing said dining article into at least one of said plurality of organizing areas.

23. The method as recited in claim 19 wherein said method further comprises the step of:

using said tray member during a predetermined activity.

24. The method as recited in claim 23 wherein said predetermined activity is target shooting.

25. The method as recited in claim 23 wherein said predetermined activity is dining.

26. A camper table comprising:

a tray member;

an elongated support having a planting end which can be forced into the ground;

a connector for detachably connecting said tray member to said elongated support; and said tray member comprising a plurality of organizing areas for receiving a plurality of articles.

27. The camper table as recited in claim 26 wherein at least one of said plurality of receiving areas is generally cylindrical.

28. The camper table as recited in claim 27 wherein at least one of said plurality of receiving areas defines a generally elongated area for receiving at least one utensil.

* * * * *